United States Patent [19]

McCants

[11] Patent Number: 4,904,345

[45] Date of Patent: Feb. 27, 1990

[54] METHOD AND APPARATUS FOR CLEANING PETROLEUM EMULSION

[76] Inventor: Malcolm McCants, 2400 Augusta, Suite 260, Houston, Tex. 77057

[21] Appl. No.: 937,248

[22] Filed: Dec. 3, 1986

[51] Int. Cl.[4] ..... C10G 33/00

[52] U.S. Cl. ..... 196/46.1; 196/117; 196/120; 196/125; 196/134; 208/179; 208/187

[58] Field of Search ..... 196/46, 46.1, 111, 117, 196/120, 122, 123, 125, 134, 136; 208/177, 186, 187, 179; 210/768, 769, 806; 159/28.1, 28.5, 15, DIG. 10, DIG. 32

[56] References Cited

U.S. PATENT DOCUMENTS

| | | | |
|---|---|---|---|
| 1,428,159 | 9/1922 | Gallsworthy | 196/117 |
| 1,528,968 | 3/1925 | Brown | 196/120 |
| 1,812,658 | 6/1931 | Loomis | 196/117 |
| 1,993,344 | 3/1935 | Jacobson | 196/117 |
| 2,354,353 | 7/1944 | Abrams | 196/120 |
| 4,179,019 | 12/1979 | Danziger | 196/46.1 |
| 4,272,359 | 6/1981 | Owen | 196/46.1 |

*Primary Examiner*—Joye L. Woodard

*Attorney, Agent, or Firm*—William R. Hinds; George H. Dunsmuir

[57] ABSTRACT

In the past, it has proven difficult to separate dirt and water from petroleum emulsions of the type found, e.g. in settling ponds. A relatively simple apparatus for effecting such separation includes a sifter or screening device for removing large solid impurities from the emulsion, a preheater for reducing the viscosity of the emulsion, a centrifuge or filter for separating most of the dirt particles from the emulsion, a settling tank for receiving the emulsion from the dirt separator, and an evaporator for separating most of the water from the petroleum. The dirt removed in the dirt separator with residual oil attached thereto is mixed with a fuel oil and burned to create the heat necessary to evaporate the water. The petroleum separated in the evaporator is cycled through the preheater for heating incoming dirty petroleum emulsion. The evaporator contains trays carrying a plurality of rows of tubes. The water-containing emulsion is fed into the uppermost tray into heat exchange contact with the tubes. The emulsion overflows through overflow pipes into subjacent trays, which also contain heating tubes. Hot gases produced by burning the mixture of dirt and fuel oil are passed through the tubes in the trays to heat the emulsion and cause evaporation of the water.

8 Claims, 2 Drawing Sheets

METHOD AND APPARATUS FOR CLEANING PETROLEUM EMULSION

BACKGROUND OF THE INVENTION

This invention relates to a method and apparatus for cleaning a petroleum emulsion.

A major environmental problem for many oil companies is the cleaning of petroleum emulsions containing large quantities of water and dirt. In general, the production of crude oil yields petroleum emulsions containing water and dirt (particulate material). This is particularly true when using steam flooding methods in the production of petroleum. Production tanks and pits containing petroleum with a high B.S. & W. (basic sediments and water) content cannot be pumped in a pipeline until the dirt and water have been removed. Refineries also accumulate dirty emulsions of water and oil in their sewer systems and A.P.I. separators. Oil separation by air floatation, pond skimming, etc. yields a mixture of oil, water and dirt. Storage tanks permit the water and dirt to settle to the bottom of the tanks, and the tanks must be cleaned periodically. In every case, petroleum can be recovered if the dirt and water can be separated from the emulsion. The recovered petroleum can then be recycled to a refinery for processing.

Attempts have been made to separate dirt and water from such emulsions in an efficient manner. Examples of the art relating to apParatuses and methods for separating water and dirt from petroleum emulsions are found in Canadian Patent No. 1,201,403, which issued to L. Bland on Mar. 4, 1986 and U.S. Pat. No. 4,334,605, which issued to F. A. Hitt on June 15, 1982. While these patents disclose methods and apParatus designed to separate water and dirt from oil, there still exists a need for an efficient and economical process and apparatus for cleaning an emulsion whereby the water recovered therefrom is sufficiently clean to meet existing standards for disposal or reuse, and the dirt is sufficiently clean to permit the disposal of the dirt as landfill.

The object of the present invention is to meet the above need by providing a relatively simple process and apparatus for separating water and/or dirt from a petroleum emulsion, so that the petroleum is acceptable for use in a refinery, and the separated water and dirt are clean enough to meet or exceed environmental safety standards.

According to one aspect, the present invention relates to a method of removing dirt and water from a petroleum emulsion comprising the steps of:

(a) screening the emulsion to remove large, non-pumpable impurities;

(b) heating the emulsion to decrease the viscosity thereof;

(c) separating dirt from the emulsion;

(d) mixing the dirt with a fuel to dilute residual petroleum on the dirt with fuel thereby producing a combustible mixture;

(e) burning the combustible mixture and using the heat produced therefrom to evaporate water from the emulsion to yield a clean petroleum of low water and dirt content; and (f) using residual heat in the clean oil to heat the emulsion in step (b).

According to another aspect, the invention relates to an apparatus for removing dirt and water from a petroleum emulsion comprising:

(a) screen means for removing large, non-pumpable, impurities from the emulsion;

(b) heater means for heating the emulsion to reduce the viscosity thereof;

(c) separator means for removing dirt from the emulsion;

(d) mixing means for mixing the dirt with fuel to product a combustible mixture of residual petroleum from the dirt and fuel;

(e) burner means for burning the combustible mixture;

(f) evaporator means for receiving heat from said burner means to evaporate water from the emulsion to yield a clean petroleum of low water and dirt content; and (g) petroleum discharge means for discharging clean, warm petroleum from said evaporator means through said heater means for heating the emulsion by heat exchange.

The process and apparatus are intended for use with petroleum emulsions ranging from heavy crude oils to light crude oils, and with refinery products or wastes containing water and/or dirt.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT(S)

Figure 1:
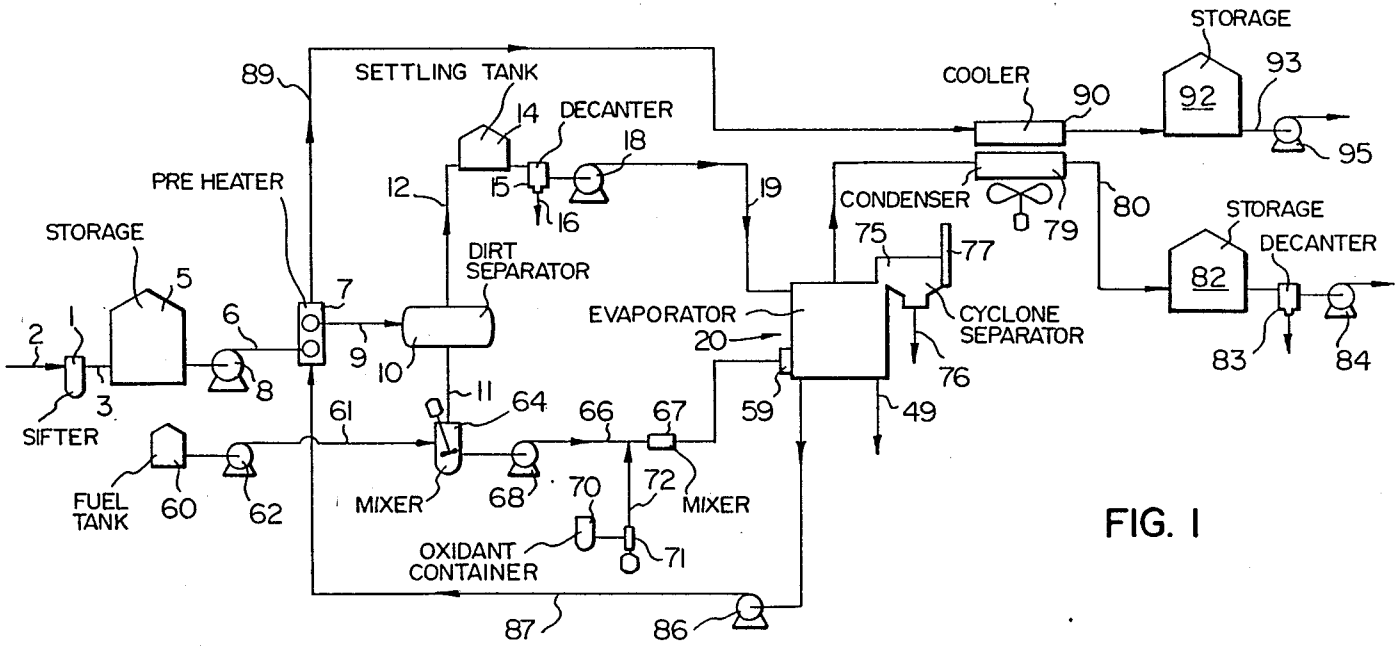
FIG. 1 is a schematic flow diagram of an apparatus in accordance with the present invention.

With reference to FIG. 1, the apparatus of the present invention includes a screening device 1 for receiving a dirty oil/water emulsion or sludge introduced into the apparatus through an inlet line 2. The emulsion is delivered to the apparatus by truck or rail, or pumped from tanks or Pits. The device 1, which may be a GUMP CP-32 PRESSURE SIFTER, is an enclosed system for screening out large articles such as rocks, bones, shells and cans. The use of an enclosed system prevents the escape of vapours. Collected articles are cleansed of oil and discarded. Screened oil is fed through line 3 to a storage tank 5. Some water may settle out of the dirty oil/water emulsion in the tank 5. Any water separating in the tank 5 is drawn off and delivered to a water cleaning system described hereinafter. The tank 5 is a standard all welded API storage tank with a water sump.

The emulsion is pumped through a line 6 to a preheater 7 by a pump 8. The preheater 7 is a plate and frame type with a complete bottom pan to catch the oil during cleaning. The pump 8 is a gear-type pump such as a WORTHINGTON pump. A positive displacement pump such as a gear pump is used because the viscosity of the emulsion may be very high. If the oil in the emulsion is of low gravity or high pour, the emulsion must be heated to reduce the viscosity before the next step in the process. Heating reduces the viscosity and the relative specific gravity of the oil.

From the preheater 7 the emulsion flows through a line 9 into a dirt separator 10 in the form of a centrifuge or filter. When a centrifuge is used, a DORR OLIVER or an equivalent is preferred. In small apparatuses with very little dirt, a dual type filter can be used. The dirt is separated from the emulsion and discharged through an outlet 11 for burning. The emulsion is cleansed of dirt to sizes of below 50 microns, usually 10 to 20 microns and to a dirt content of 0.1–0.3% by weight. The separated dirt remains coated with oil. The dirt contains 6 to 10% by weight oil and cannot be discarded without removal of the oil.

The emulsion containing particulates no larger in diameter than 50 microns is discharged through an outlet tube 12 to a water settling tank 14. Some water settles in the tank 14 and is separated in a decanter 15. The decanter 15 is a decantation valve, e.g. a BELFIELD decantation valve or the equivalent. The water is discharged through an outlet 16 to a settling pond. A gear-type pump 18 (a WORTHINGTON or equivalent) feeds the remaining emulsion through a line 19 to an evaporator generally indicated at 20.

Figures 2, 3, 4:
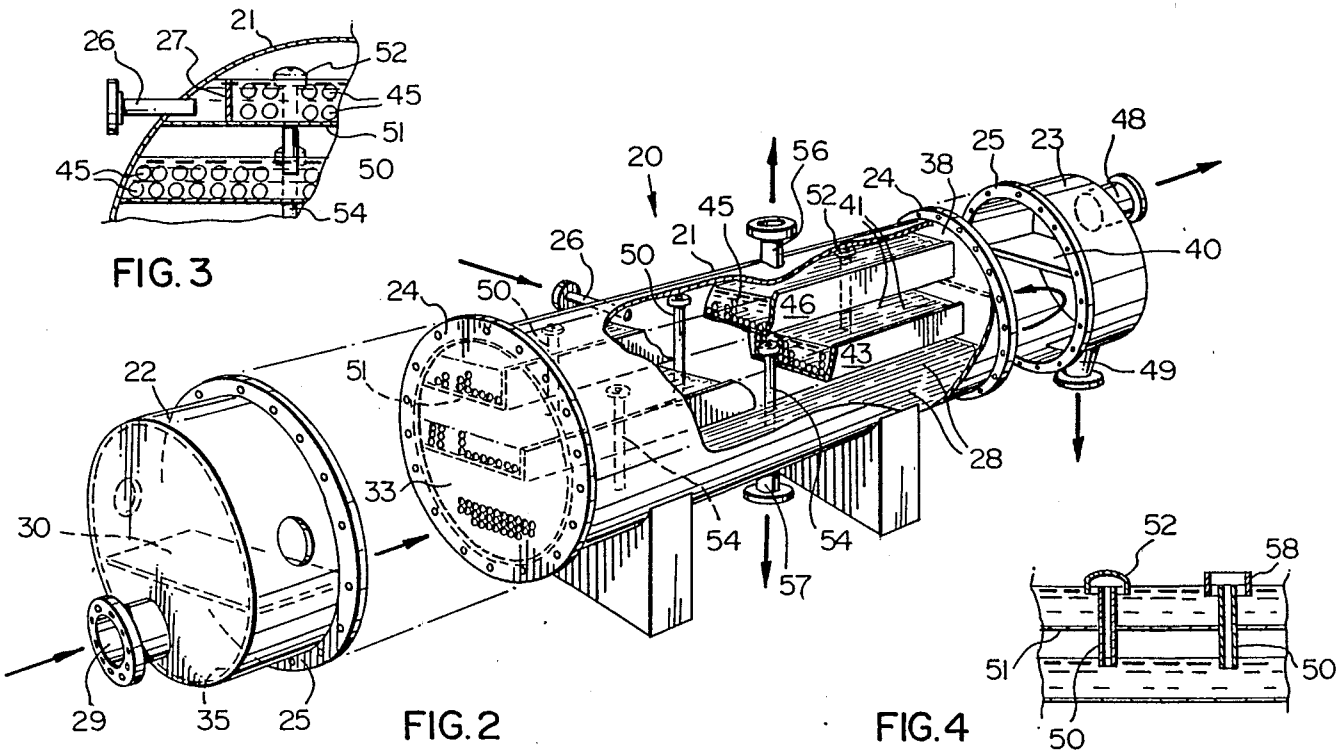
FIG. 2 is a partly sectioned, exploded perspective view of an evaporator for use in the apparatus of FIG. 1.
FIG. 3 is a cross section of a portion of the evaporator of FIG. 2.
FIG. 4 is a schematic cross section of two types of overflow pipes for use in the evaporator of FIGS. 2 and 3.

With reference to FIGS. 2 and 3, the evaporator 20 is defined by a cylindrical casing 21 with cylindrical covers 22 and 23 closing the ends thereof. Flanges 24 and 25 are provided on the casing and covers, respectively for interconnecting these elements of the apparatus. Petroleum emulsion is introduced tangentially into the casing 21 through an inlet duct 26 near one side of the top end of the casing. Emulsion entering the casing 21 hits an impingement plate 27 (FIG. 3). The casing contains a plurality of layers of gas carrying tubes 8 on the bottom of the inner wall thereof. Hot gas is introduced into the tubes 28 through an inlet duct 29 in the outer end of the cover 22. A horizontal baffle 30 in the cover 22 and a vertical partition or baffle 33 in the casing 21 define a bottom inlet chamber or manifold 35. Gas flowing through the tubes 28 passes through a vertical baffle or end wall 38 between the other end of the casing 21 and the cover 23, and enters the cover 23. The partitions 33 and 38 extend outwardly beyond the periphery of the casing 21 to define the flanges 24. Cover 23 also contains a horizontal baffle 40 above the baffle 30 for deflecting the hot gases back into a plurality of tubes 41 in the middle of the casing 21. The tubes 41 are mounted in a middle tray 43, and extend into the vertical partition 38. Thus, substantially all of the hot gases are diverted through the tubes 41 flowing back into the cover 22 above the baffle 30 where the hot gases are again diverted into tubes 45 carried by an upper tray 46. The tray 46 extends a shorter distance from the side of the casing 21 than the tray 43, i.e. the tray 43 is wider than the tray 46. The tubes 45 and the tray 46 extend between the vertical partitions 33 and 38, so that the hot gases are discharged from the pipes 45 over the baffle 40 for discharge through an outlet 48 in the cover 23. Any solids remaining in the hot gas passing through the casing 21 are discharged through a hopper-type outlet 49 in the cover 23.

The emulsion entering the casing 21 fills the top tray 46. During filling of such top tray 46, the emulsion is in heat exchange relationship with the tubes 45 to initiate evaporation of the water contained in the emulsion. When the level of the emulsion in the tray 46 reaches a predetermined level, the emulsion overflows into overflow pipes 50, which extend upwardly through the base 51 of the tray 46 to above the tubes 45. The pipes 50 maintain the level of the liquid high enough to cover the tubes 45. A vented cap 52 is provided on the top end of each overflow pipe 50 for preventing plugging of or reduced flow in the overflow pipe because of foam on the emulsion. The emulsion flows downwardly through the pipes 50 into the subjacent middle tray 43 for further heat exchange contact with the tubes 41 in such tray 43. The gas in the tubes 41 is hotter than the gas in the tubes 45, and consequently more water is evaporated from the emulsion. In a similar manner, when the tray 43 becomes filled, emulsion overflows into overflow tubes 54 in the tray 43 to cover the pipes 28. Thus, additional heat is added to the emulsion to evaporate more water therefrom. The steam leaving the emulsion is discharged through an outlet duct 56 in the top of the casing 21. The emulsion is discharged through an outlet 57 in the bottom of the casing 21. The emulsion is at a temperature of at least 300° F. and preferably 350° F. Referring to FIG. 4, the vented cap 52 on the pipe 50 or 54 can be replaced by a cylindrical sleeve 58 with an open top end.

The evaporator 20 normally operates at approximately 5 to 10 psig, which is sufficient pressure to cause vapour to flow through the outlet duct 56. The evaporator can operate at lower pressures by placing a vapour compressor downstream of the outlet duct 56. The temperatures in the various sections of the evaporator will vary with pressure. At 5 psig the temperature of the upper section will normally be 230° F., the temperature of the middle section will be approximately 235° to 240° F., and the temperature of the bottom or lower section will be 300° to 350° F. By controlling the outlet temperature of the lower section, the water content of the oil can be reduced to a minimum, usually 0.1% or less.

Referring again to FIG. 1, the hot gas for use in the evaporator 20 is produced by a burner 59 (FIG. 1). The fuel for the burner 59 is a mixture of the dirt discharged from the separator 10 through line 11, and the fuel oil. The fuel oil is pumped from a tank 60 through a line 61 by a pump 62 to a mixer 64. The fuel oil and dirt are mixed in the mixer 64, so that the oil coating the dirt mixes with the fuel oil to produce a combustible mixture. The mixture thus produced is pumped through a line 66 and a static mixer or blender 67 by a pump 68 to the burner 59. In order to facilitate complete combustion of the oil on the particulate dirt, an oxidant such as Varichem S.W.F. (trade mark) can be pumped from a container 70 through a pump 71 and a line 72 into the line 66 for mixing with the above mentioned combustible mixture of dirt and fuel oil.

Following combustion, and passage through the casing 21, the particulate material is removed from the cover 23 through the outlet 49. The hot gas discharged through the outlet 48 enters a cyclone separator 75. Additional dust separated from the hot gas in the separator 75 is discharged through an outlet 76. The hot gas is discharged through a stack 77. If the cyclone separator 75 does not remove sufficient fines, a sock filter can be added to the stack 77 to further reduce the Particulates in the flue gas.

When the emulsion is heated in the evaporator 20, the water turns to steam and is discharged through the outlet 56. Some of the oil is steam distilled and turns to vapour, which is also discharged through the outlet 56. The steam and oil leaving the evaporator 20 are fed into a condenser 79. The resulting liquid mixture is fed through a pipe 80 to a storage tank 82. Liquid from the storage tank 82 passes into a water decanter 83, where water is withdrawn and pumped to a truck or other means of transportation by a pump 84. Water from the decanters 15 and 83, and from the tanks 5, 14 and 82 is collected in a skimming pond, where the remaining traces of oil are skimmed from the water. The water can then be filtered through a hydrophobic or oleophilic filter to remove any undissolved oil. Water thus obtained has been distilled, and is low in salts and pure enough for disposal, meeting exiting environmentally safe regulations.

The emulsion cleaned in the evaporator 20 contains less than 0.3% by volume water as measured by "Water By Distillation" ASTM. D-96, and less than 0.5% by volume dirt and water, and consequently is clean enough for a pipeline or refinery. The emulsion passes through the outlet 57, a pump 86 and a line 87 to the heater 7, where the residual heat in the clean petroleum is reclaimed for heating the emulsion being fed into the centrifuge or filter 10. Thereafter, the petroleum passes through a line 89 to a cooler 90 for cooling the product, which is then fed to a storage tank 92 for subsequent discharge through a line 93 and a pump 95 into a pipeline, tank, tank truck, rail car or other means of transportation.

Dirt removed from the evaporator 20 and the cyclone separator 75 is collected. All of the hydrocarbons have been burned from the dirt, and converted to carbon dioxide and water. Any metals contained in the petroleum are completely oxidized. In general, the oxides are inert and do not constitute hazardous waste.

What is claimed is:

1. A method of removing dirt and water from a petroleum emulsion comprising the steps of:

(a) screening the emulsion to remove large, non-pumpable impurities;

(b) heating the screened emulsion from step (a) to decrease the viscosity thereof;

(c) separating dirt from the heated emulsion from step (b);

(d) mixing the separated dirt with a fuel to dilute residual petroleum on the dirt with fuel thereby producing a combustible mixture;

(e) burning the combustible mixture and using the heat produced therefrom to evaporate water from the emulsion from step (c) to yield a clean petroleum of low water and dirt content; and (f) using residual heat in the clean petroleum from step (e) to heat the emulsion in step (b).

2. A method according to claim 1, wherein the combustible mixture is burned to produce hot gases, and said gases are placed in heat exchange relationship with the emulsion in step (e).

3. A method according to claim 2, wherein the gases are placed in heat exchange relationship with the emulsion on a discontinuous basis during multiple passes of the gases into, through, and out of successive tubes surrounded by the emulsion.

4. A method according to claim 2, wherein the dirt separated from the emulsion is mixed with fuel oil to mix residual petroleum separated with the dirt with the fuel oil for producing said combustible mixture.

5. A method according to claim 4, wherein an oxidant is added to said combustible mixture to increase the combustibility of the mixture.

6. A method as claimed in claim 1 wherein said separating of dirt is by a centrifuge having a dirt outlet connected to a mixer which has an inlet connected to a fuel supply and a mixture outlet connected to a burner for burning the combustible mixture.

7. An apparatus for removing dirt and water from a petroleum emulsion comprising:

(a) screen means for removing large, non-pumpable, impurities from the emulsion;

(b) heater means for receiving and heating the screened emulsion to reduce the viscosity thereof;

(c) separator means for receiving heated emulsion from the heater means and removing dirt from the heated emulsion so received;

(d) mixing means for receiving and mixing the removed dirt with fuel to produce a combustible mixture of residual petroleum from the dirt and fuel;

(e) burner means for burning the combustible mixture;

(f) evaporator means for receiving emulsion from the separator means and heat from said burner means to evaporate water from the received emulsion to yield a clean petroleum of low water and dirt content; and (g) petroleum discharge means for discharging clean, warm petroleum from said evaporator means through said heater means for heating the emulsion by heat exchange.

8. Apparatus as claimed in claim 7 wherein said separator means is a centrifuge having a dirt outlet connected to said mixing means, and said mixing means has an inlet connected with a fuel supply and has a mixture outlet connected with said burner means.

* * * * *